US010133229B2

(12) United States Patent
Iwasaki

(10) Patent No.: US 10,133,229 B2
(45) Date of Patent: Nov. 20, 2018

(54) IMAGE FORMING APPARATUS

(71) Applicant: KONICA MINOLTA, INC., Tokyo (JP)

(72) Inventor: Takahiro Iwasaki, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/834,662

(22) Filed: Dec. 7, 2017

(65) Prior Publication Data

US 2018/0164737 A1 Jun. 14, 2018

(30) Foreign Application Priority Data

Dec. 12, 2016 (JP) ..... 2016-240022

(51) Int. Cl.

| | |
|---|---|
| ***G03G 21/20*** | (2006.01) |
| ***G03G 21/10*** | (2006.01) |
| ***G03G 21/12*** | (2006.01) |
| *G03G 15/08* | (2006.01) |
| *G03G 21/16* | (2006.01) |

(52) U.S. Cl.

CPC ..... *G03G 21/10* (2013.01); *G03G 21/12* (2013.01); *G03G 21/206* (2013.01); *G03G 15/08* (2013.01); *G03G 15/0856* (2013.01); *G03G 21/16* (2013.01)

(58) Field of Classification Search

CPC ..... G03G 21/10; G03G 21/12; G03G 21/206; G03G 15/08; G03G 15/0856; G03G 21/16

USPC ..... 399/93

See application file for complete search history.

(56) References Cited

U.S. PATENT DOCUMENTS

| | | | | |
|---|---|---|---|---|
| 3,633,544 A * | 1/1972 | Weiler | G03G 15/0803 118/312 |
| 5,842,089 A * | 11/1998 | Kunihiro | G03G 15/08 399/223 |
| 2018/0136602 A1* | 5/2018 | Hashimura | B01D 46/2411 |

FOREIGN PATENT DOCUMENTS

JP 2013160843 A 8/2013

* cited by examiner

*Primary Examiner* — Susan S Lee
(74) *Attorney, Agent, or Firm* — Lucas & Mercanti, LLP

(57) ABSTRACT

An image forming apparatus includes a cyclone portion, a bin, a filter, a fan, a detector and a corrector. The cyclone portion separates toner from air containing dispersed toner by centrifugation. The bin stores the toner separated by the cyclone portion. The filter filters the air from which the toner has been separated by the cyclone portion. The fan generates an air flow for discharging the air which has passed through the filter. The detector detects the bin being full of the toner based on a change of a rotation speed of the fan. The corrector corrects the rotation speed of the fan based on a change of a physical property of the air which corresponds to a change of an environmental condition in image formation.

12 Claims, 6 Drawing Sheets

IMAGE FORMING APPARATUS

BACKGROUND

1. Technological Field

The present invention relates to an image forming apparatus.

2. Description of the Related Art

Electrophotographic image forming apparatuses that form an image on a sheet with toner have been known in the art.

Some of such image forming apparatuses include a toner collector that vacuums dispersed toner in a developer, separates it in a cyclone portion by centrifugation, collect it in a bin and further traps residual toner on a filter that has not been collected by the centrifugation (e.g. see JP 2013-160843A).

When the bin is filled up with toner to the capacity, the toner is blown up to clog the filter, and the toner is consequently dispersed in the image forming apparatus. As a solution to the problem, JP 2013-160843A discloses providing an optical sensor for detecting clogging of a filter and controlling the air flow through a toner collector in response to a detection of clogging by the sensor. However, since it is difficult to properly prevent dispersion of toner once the filter is clogged, it is desirable to detect the bin being full before the filter is clogged.

It would be possible to provide an optical sensor in the bin to detect the bin being full. However, a problem with this configuration is that it is difficult to perform the detection with high accuracy since airborne toner smears the detector of the sensor.

SUMMARY

The present invention has been made in view of the above-described problem, and an object thereof is to provide an image forming apparatus that can detect a bin being full of toner before a filter is clogged.

To achieve at least one of the abovementioned objects, according to an aspect of the present invention, an image forming apparatus includes:

a cyclone portion which separates toner from air containing dispersed toner by centrifugation;

a bin which stores the toner separated by the cyclone portion;

a filter which filters the air from which the toner has been separated by the cyclone portion;

a fan which generates an air flow for discharging the air which has passed through the filter;

a detector which detects the bin being full of the toner based on a change of a rotation speed of the fan; and a corrector which corrects the rotation speed of the fan based on a change of a physical property of the air which corresponds to a change of an environmental condition in image formation.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
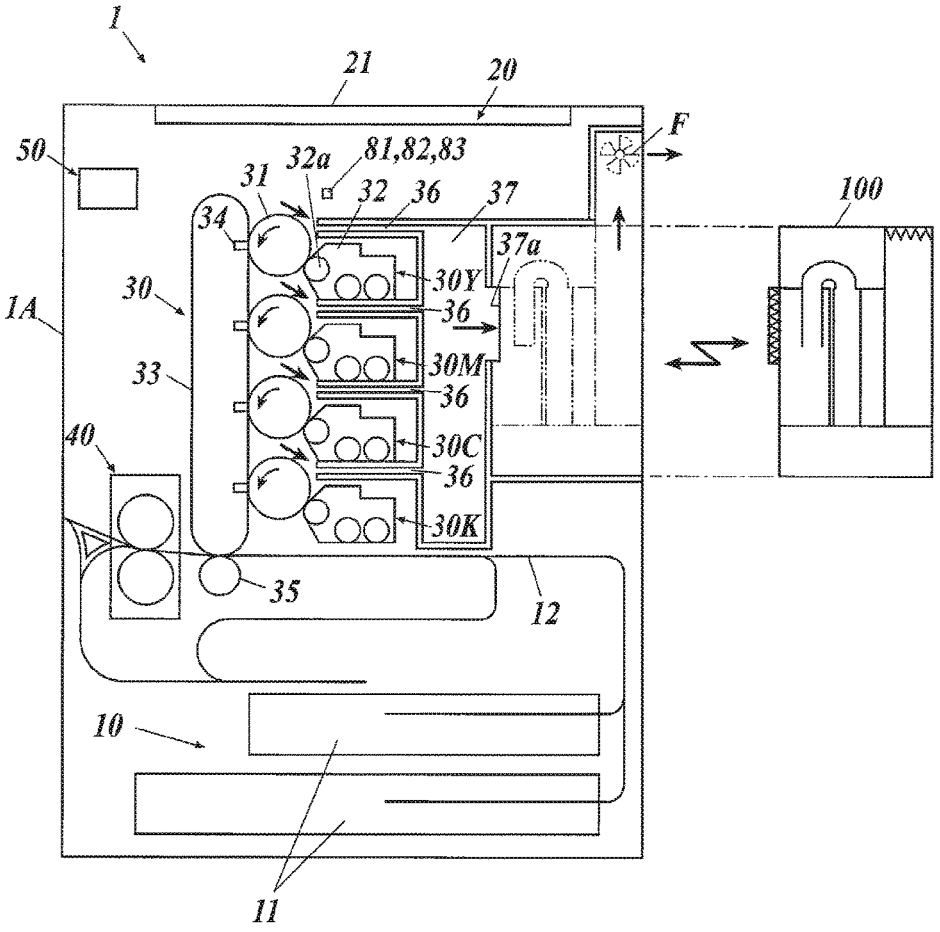
FIG. 1 is a schematic view of the overall configuration of an image forming apparatus according to an embodiment of the present invention.
Figure 2:
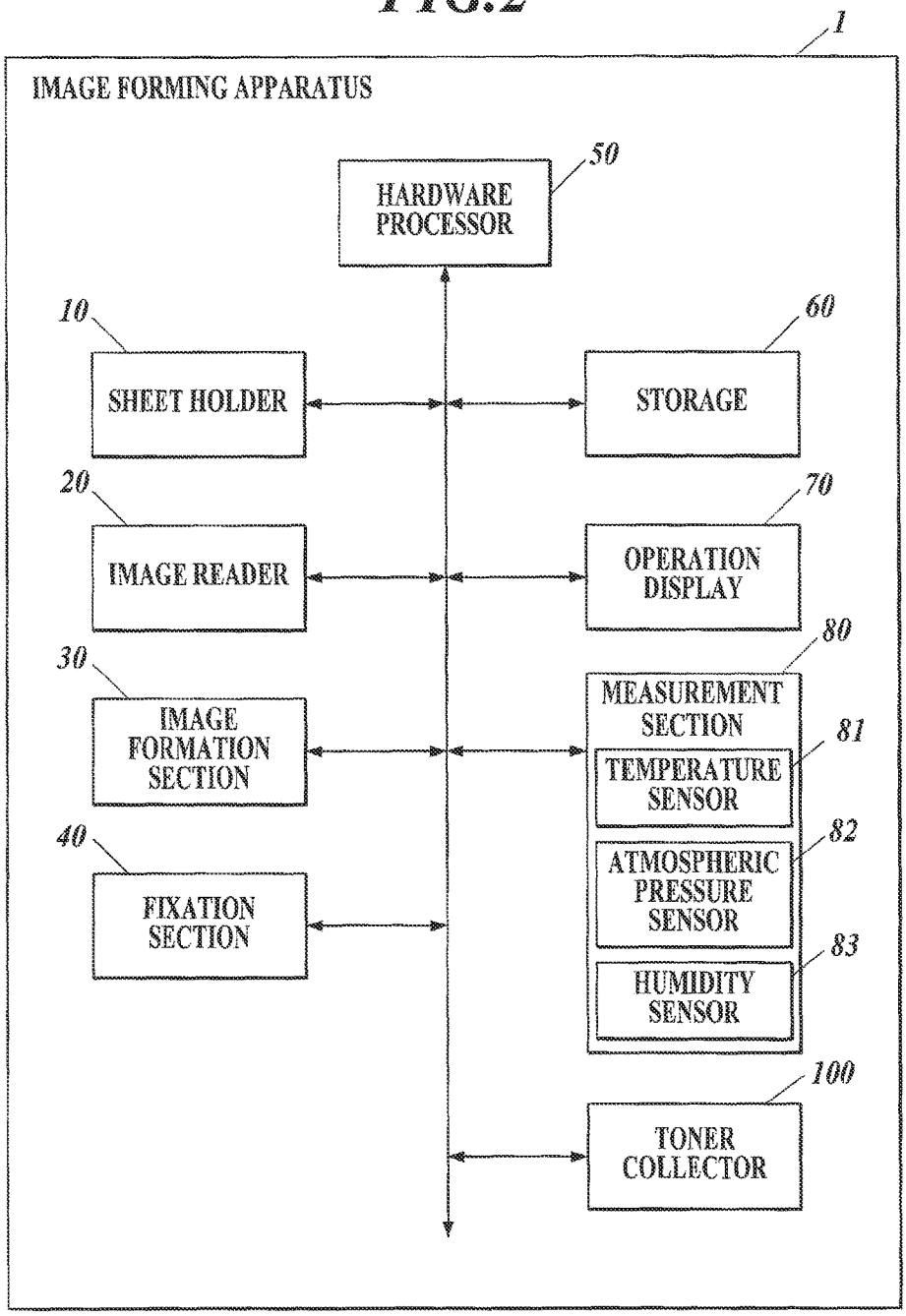
FIG. 2 is a block diagram of the functional configuration of the image forming apparatus in FIG. 1.

FIG. 1 is a schematic view of the overall configuration of an image forming apparatus 1. FIG. 2 is a block diagram of the functional configuration of the image forming apparatus 1.

The image forming apparatus 1 of the embodiment, which forms an image on a sheet by electrophotography, is specifically a tandem color image forming apparatus that overlays four color toners of yellow (Y), magenta (M), cyan (C) and black (K).

As illustrated in FIG. 1 and FIG. 2, the image forming apparatus 1 includes, for example, an apparatus main body 1A with an approximately rectangular box shape that defines the exterior of the apparatus. In the apparatus main body 1A, a sheet holder 10, an image reader 20, an image formation section 30, a fixation section 40, a hardware processor 50, a storage 60, an operation display 70, a measurement section 80 and a toner collector 100 are disposed.

The sheet holder 10 is disposed in the lower part of the image forming apparatus 1. The sheet holder 10 includes trays 11 corresponding to different sizes and types of sheets. A sheet is fed from a tray 11 to a conveyer 12 and is conveyed to the image formation section 30 and the fixation section 40 by the conveyer 12.

The image reader 20 reads the image of an original conveyed by an original conveyer (not shown) or mounted on an original table 21 to generate image data. Further, the image reader 20 performs image processing such as shading correction, dithering and compression on the image data generated by A/D conversion and stores the processed image data in a RAM (not shown) of the hardware processor 50, which is described later.

The image data is not limited to data that is output from the image reader 20, and may also be data that is received from an external apparatus such as a personal computer or another image forming apparatus connected to the image forming apparatus 1.

The image formation section 30 forms an image on a sheet based on an image forming job.

The image formation section 30 includes four image forming units 30Y, 30M, 30C and 30K corresponding respectively to Y, M, C and K color components, an intermediate transfer belt 33, an primary transfer unit 34 and a secondary transfer roller 35.

Each of the image forming units 30Y, 30M, 30C and 30K includes a drum photoreceptor 31 and a developer 32 disposed around the photoreceptor 31, and although not shown in the drawings, further includes a charger, an exposer and a cleaner and the like.

The exposer emits a laser beam to the photoreceptor 31 with the surface charged by the charger to expose the photoreceptor 31 so as to form an electrostatic latent image on the photoreceptor 31. The developer 32 feeds toner of a predetermined color (Y, M, C or K) to the surface of the exposed photoreceptor 31 by means of a development roller 32*a* so as to develop the electrostatic latent image formed on the photoreceptor 31.

Y, M, C and K toner images (single color images) thus formed on the corresponding four photoreceptors 31 for Y, M, C and K colors are transferred from the photoreceptors 31 to the intermediate transfer belt 33. The intermediate transfer belt 33 is an endless belt winded around conveyance rollers, which rotates along with the rotation of the conveyance rollers.

At the inner side of the intermediate transfer belt 33, a primary transferring section 34 is disposed opposed to the photoreceptors 31 of the image forming units 30Y, 30M, 30C and 30K. The primary transfer belt 34 applies a voltage with the opposite polarity to that of the toner to the intermediate transfer belt 33, so as to transfer the toner attached on the photoreceptors 31 to the intermediate transfer belt 33.

The intermediate transfer belt 33 is rotary driven so that the toner images formed by the four image forming units 30Y, 30M, 30C and 30K are sequentially transferred on the surface of the intermediate transfer belt 33. That is, the toner images of Y, M, C and K color components are mutually overlaid on the intermediate transfer belt 33 to form a color image.

At the outer side of the intermediate transfer belt 33, a secondary transfer roller 35 is disposed at an opposed position. The secondary transfer roller 35 is in contact with the intermediate transfer belt 33 in the nipping portion, which is the transferring site where the secondary transfer roller 35 brings a sheet conveyed by the conveyer 12 into contact with the intermediate transfer belt 33 to transfer the toner image formed on the outer surface of the intermediate transfer belt 33 to the sheet.

At the sheet ejection side of the secondary transfer roller 35, a fixation section 40 is disposed.

The fixation section 40 includes a pair of rollers, which are a heating roller and a pressing roller. The sheet is subjected to heat and pressure when it passes through the nipping portion of the pair of rollers, so that the transferred toner image is fused and fixed on the sheet.

Above the developers 32 of the four image forming units 30Y, 30M, 30C and 30K, respective vacuum ducts 36 are disposed. That is, four vacuum ducts 36 are provided corresponding to the four image forming units 30Y, 30M, 30C and 30K. Through the vacuum ducts 36, toner-containing air that contains toner dispersed in the respective image forming units 30Y, 30M, 30C and 30K flows.

The four vacuum ducts 36 are connected to a common duct 37. The common duct 37 is formed in a hollow rectangular box shape that extends in the vertical direction. The common duct 37 serves as a receiver of a detachable toner collector 100 (described in detail later) and a guide to let the toner-containing air flow from the four vacuum ducts 36 to the toner collector 100.

On the side wall of the common duct 37 opposed to the four image forming units 30Y, 30M, 30C and 30K, four communication openings (not shown) are formed to which the vacuum ducts 36 can be connected. On the opposite side wall of the common duct 37 to the side wall opposed to the four image forming units 30Y, 30M, 30C and 30K, a connection opening 37*a* is formed to which an inlet opening 101 (see FIG. 3) of the toner collector 100 is connected.

Above the toner collector 100 attached to the common duct 37, a fan F is disposed. The fan F generates air flow from the common duct 37 to the outside of the image forming apparatus 1 through the toner collector 100. Specifically, the air flows from the common duct 37 into the toner collector 100 and then out of the toner collector 100 through an outlet opening 106 (see FIG. 3). The air is then discharged out of the image forming apparatus 1 through the fan F.

Further, the fan F outputs a pulse signal for calculating the rotation speed (number of rotations per unit time) to the hardware processor 50.

The hardware processor 50 is constituted by a CPU (Central Processing Unit), a RAM (Random Access Memory) and the like. The CPU of the hardware processor 50 reads out a variety of programs stored in the storage 60 such as a system program and processing programs, develops them in the RAM and performs a variety of processing such as image formation processing and toner collection processing according to the developed programs.

The toner collection processing will be described later.

The storage 60 is constituted by, for example, an HDD (Hard Disk Drive), a semiconductor non-volatile memory or the like.

In the storage 60, the variety of programs such as the system program and the processing programs to be executed by the hardware processor 50 and necessary data for executing the programs are stored.

The operation display 70 includes a display that displays various information on a screen and an operation interface that allows a user to input a variety of commands.

The measurement section 80 measures the environmental conditions in which the image forming apparatus 1 forms an image. Specifically, the measurement section 80 includes a temperature sensor 81, an atmospheric pressure sensor 82 and a humidity sensor 83. The measurement section 80 outputs a detection signal relating to the temperature detected by the temperature sensor 81 to the hardware processor 50, a detection signal relating to the atmospheric pressure detected by the atmospheric pressure sensor 82 to the hardware processor 50 and a detection signal relating to the humidity detected by the humidity sensor 83 to the hardware processor 50.

For example, the temperature sensor 81, the atmospheric pressure sensor 82 and the humidity sensor 83 are disposed at a predetermined position in the image formation section 30, specifically above the four image forming units 30Y, 30M, 30C and 30K.

The temperature sensor 81, the atmospheric pressure sensor 82 and the humidity sensor 83 may also be disposed at any other suitable position where they can properly measure a change of the environmental conditions that affects the physical properties (e.g. density) of the air passing through the fan F.

Next, the toner collector 100 will be described referring to FIG. 3.

Figure 3:
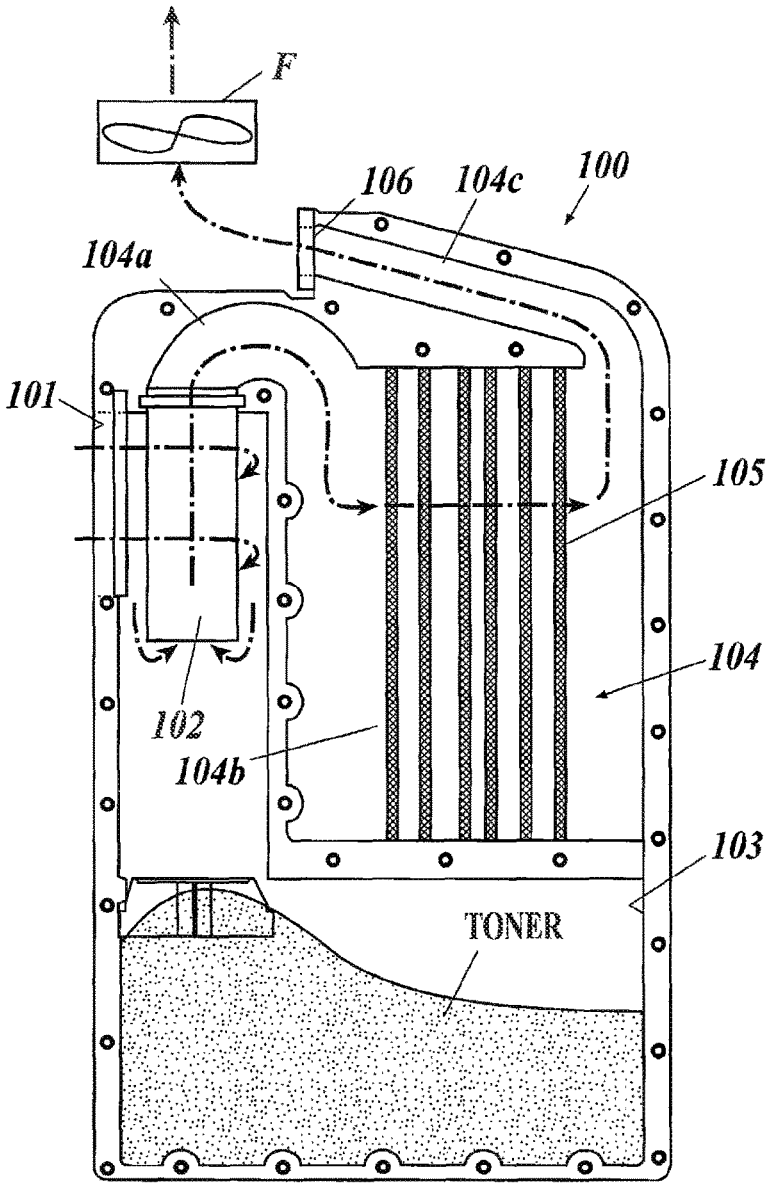
FIG. 3 is a schematic view of a toner collector of the image forming apparatus in FIG. 1.

FIG. 3 is a schematic view of the toner collector 100. In FIG. 3, the air flow is schematically illustrated by dashed-dotted lines.

As illustrated in FIG. 3, the toner collector 100 is formed, for example, in an approximately rectangular box outer shape. The toner collector 100 is detachable from the common duct 37 of the apparatus main body 1A. The toner collector 100 includes the inlet opening 101, a cyclone portion 102, a bin 103, an air channel 104, a filter 105 and the outlet opening 106.

Through the inlet opening 101, the toner-containing air that has passed through the common duct 37 is taken in.

When the toner collector 100 is attached to the common duct 37, the inlet opening 101 is opposed to the connection opening 37*a* of the common duct 37. The cyclone portion 102 is thus communicated with the inner space of the common duct 37 though the inlet opening 101.

The cyclone portion 102 separates toner by centrifugation from the toner-containing air that has passed through the common duct 37 and flown in through the inlet opening 101. The cyclone portion 102 is formed in a cylindrical shape with the axis in the vertical direction (direction of gravity). This position of the axis being in the vertical direction is optimal for separating toner from the toner-containing air.

The toner-containing air taken in the cyclone portion 102 flows in the tangential direction of the inner circumference of the cyclone portion 102. This produces swirling flow of the air inside the cyclone portion 102.

The toner in the swirling flow deviates in the radial direction by the action of centrifugal force, which is a force acting on an object in circular motion, so that most of the toner is separated from the air (by centrifugation). The separated toner falls downward due to its own weight and is stored in the bin 103. In contrast, the air flows into the inner side of the cyclone portion 102 through the lower end of the cylinder of the cyclone portion 102 and then flows to the inlet 104*a* of the air channel 104 disposed on the top of the cyclone portion 102.

The air channel 104 includes the inlet 104*a* that is communicated with the cyclone portion 102, a filter room 104*b* that is communicated with the inlet 104*a* and an outlet 104*c* that is communicated with the filter room 104*b*.

The inlet 104*a* is formed in a U-shaped pipe. The inlet 104*a* diverts the air flow from the cyclone portion 102 to the vertically opposite direction to guide it to the filter room 104*b*.

In the filter room 104*b*, the filter 105 for filtrate the toner is disposed.

The air that has passed through the cyclone portion 102 contains a minute amount of toner, and the filter 105 is provided to collect it so as to clean the air that passes through the filter 105.

It is preferred to dispose two or more filters 105 that are layered in the air flow direction since such configuration increases the air cleaning performance. For example, a toner dust filter, an ozone catalytic filter, a toner dust filter and the like are disposed in a predetermined arrangement in the filter 105.

The air that has passed through the filter 105 in the filter room 104*b* flows into the outlet 104*c* disposed on the top of the filter room 104*b* and then flows out toward the fan F through the outlet opening 106 that is formed at the downstream side (the other side from the side facing the cyclone portion 102) of the outlet 104*c* in the air flow direction.

In this way, the air that is vacuumed through the vacuum duct 36 passes through the common duct 37, the inlet opening 101, the cyclone portion 102, the inlet 104*a*, the filter room 104*b* (filter 105), the outlet 104*c* and the outlet opening 106. Thereafter, the air passes through the fan F and is discharged out of the image forming apparatus 1.

The cyclone portion 102, the bin 103 and the filter 105 of the toner collector 100 are integrally formed. The cyclone portion 102, the bin 103 and the filter 105 are replaceable as one piece, for example, when the bin 103 is filled up with toner to the capacity.

Toner Collection Processing

Next, the toner collection processing performed by the hardware processor 50 will be described in detail referring to FIG. 4A to FIG. 8.

Figure 4A:
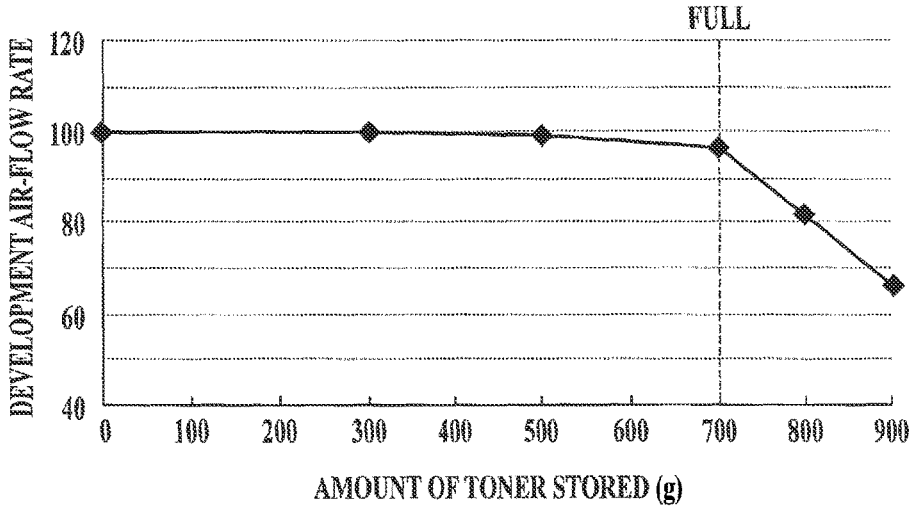
FIG. 4A illustrates the relationship between the amount of toner stored and development air-flow rate.
Figure 4B:
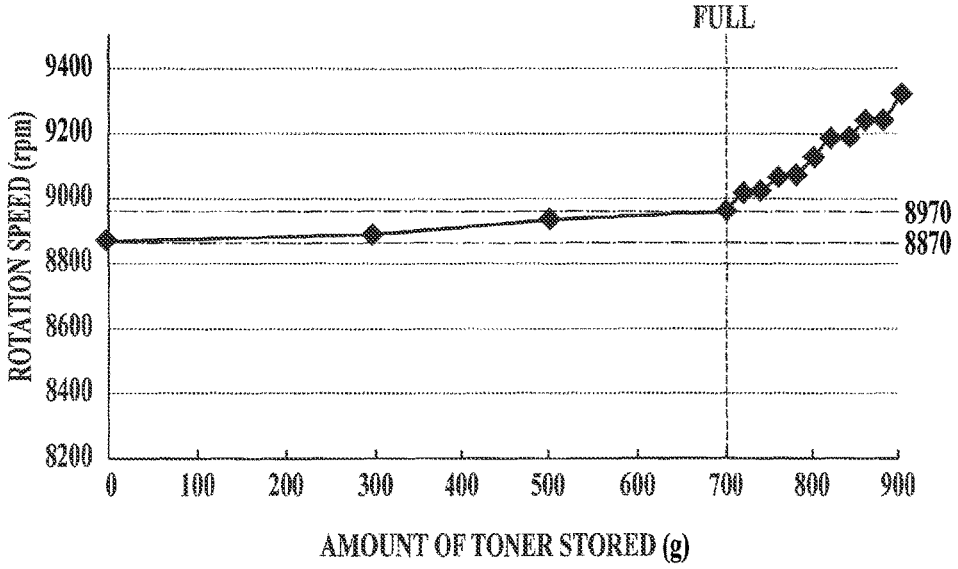
FIG. 4B illustrates the relationship between the amount of toner stored and rotation speed of a fan.

FIG. 4A illustrates the relationship between the amount of toner stored and development air-flow rate, and FIG. 4B illustrates the relationship between the amount of toner stored and rotation speed of the fan F.

In FIG. 4A and FIG. 4B, the rotation speed of the fan F is selected so that 98% of the toner in the toner-containing air is collected in the bin 103 (the toner separation efficiency of the cyclone portion 102 is 98%) at a temperature of 20° C., a humidity of 50% and an atmospheric pressure of 1002 hPa. That is, 2% of the toner in the toner-containing air is not collected in the bin 103 but is trapped on the filter 105 (by filtration).

The toner capacity of the bin 103 is 700 g, but this is merely an example. The present invention is not limited thereto, and the capacity can be suitably changed. In FIG. 4A, the flow rate (development air-flow rate) of the air (toner-containing air) passing through the vacuum ducts 36 is a normalized value that is 100 when the amount of toner stored is 0 g.

As illustrated in FIG. 4A, when the toner separation efficiency of the cyclone portion 102 is high, the filter 105 is less likely to be clogged. Accordingly, the development air-flow rate is less likely to be decreased until the bin 103 is filled up with toner to the capacity.

However, once the bin 103 is filled up with toner to the capacity, the toner in the bin 103 is blown up to cause clogging of the filter 105. As a result, the development air-flow rate is decreased, and toner is dispersed in the image forming apparatus 1. In order to prevent such dispersion of toner in the image forming apparatus 1, it is necessary to detect the bin 103 being full before the filter 105 is clogged instead of to detect clogging of the filter 105 by means of a sensor, which occurs after the bin 103 becomes full.

As illustrated in FIG. 4B, when the toner separation efficiency of the cyclone portion 102 is 98%, the rotation speed of the fan F is 8870 rpm in a brand-new condition in which image formation with the image forming apparatus 1 has not been performed yet.

Once image formation with the image forming apparatus 1 is started, toner is gradually collected in the bin 103 and trapped on the filter 105. Accordingly, the flow rate of the air flowing thorough the fan F decreases, and the rotation speed of the fan F driven at a predetermined voltage increases with a decrease of the rotational load. When the bin 103 is full of toner, the rotation speed of the fan F reaches 8970 rpm. After the bin 103 becomes full, the toner in the bin 103 is blown up to cause clogging of the filter 105, and the rotation speed of the fan F increases rapidly.

That is, the rotation speed of the fan F when the bin 103 is full is slightly faster than in a brand-new condition by only 100 rpm, i.e. approximately 1.1%. Therefore, it is considered that high accuracy is required to detect the bin 103 being full based on the change of rotation speed of the fan F. In particular, it is considered necessary to take the physical properties (e.g. density) of the air passing through the fan F into consideration.

The influence of the physical properties of the air on the rotation speed of the fan F will be described referring to FIG. 5.

Figure 5:
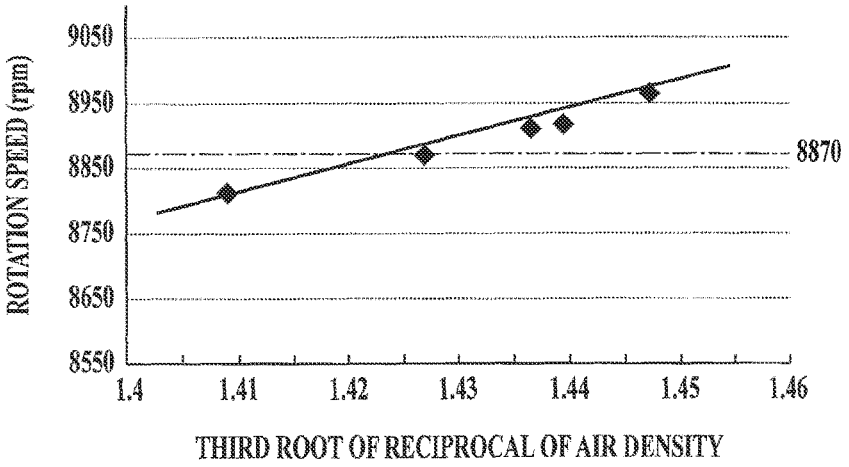
FIG. 5 illustrates the relationship between the third root of the reciprocal of air density and rotation speed of the fan.

FIG. 5 illustrates the relationship between the third root of the reciprocal of air density and rotation speed of the fan F.

Specifically, FIG. 5 illustrates the result of measuring the rotation speed of the fan F while the air density is changed by controlling the temperature at a humidity of 50% and an atmospheric pressure of 1002 hPa. The relationship between the third root of the reciprocal of air density and rotation speed of the fan F is determined by linear approximation.

The fan F is in a brand-new condition in which image formation with the image forming apparatus 1 has not been performed yet.

As illustrated in FIG. 5, as the air density decreases (as the third root of the reciprocal of the air density increases), the rotation speed of the fan F driven at a predetermined voltage increases with a decrease of the rotational load.

Since air density depends on temperature, atmospheric pressure, humidity and the like, the influence of temperature, atmospheric pressure and humidity on the rotation speed of the fan F is individually discussed below.

First, the influence of temperature on the rotation speed of the fan F will be described referring to FIG. 6.

Figure 6:
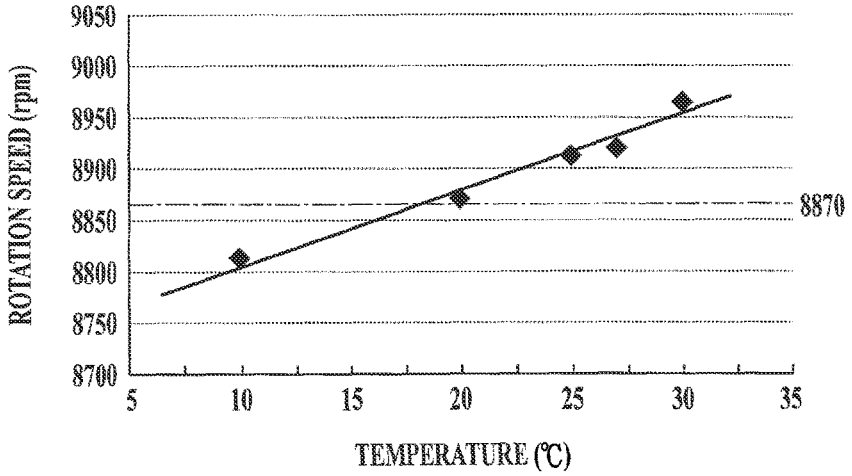
FIG. 6 illustrates the relationship between temperature and rotation speed of the fan.

FIG. 6 illustrates the relationship between temperature and rotation speed of the fan F.

Specifically, FIG. 6 illustrates the result of measuring the rotation speed of the fan F while the temperature is changed at a humidity of 50% and an atmospheric pressure of 1002 hPa. The relationship between temperature and rotation speed of the fan F is determined by linear approximation.

The fan F is in a brand-new condition in which image formation with the image forming apparatus 1 has not been performed yet.

As illustrated in FIG. 6, as the temperature increases, the rotation speed of the fan F driven at a predetermined voltage increases with a decrease of the rotational load. This is because the air density decreases with an increase of the air volume.

Next, the influence of humidity on the rotation speed of the fan F will be described referring to FIG. 7.

Figure 7:
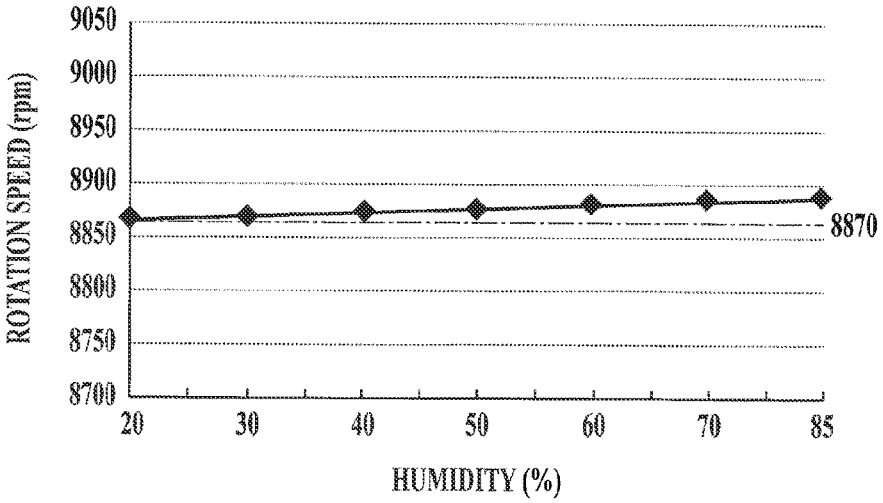
FIG. 7 illustrates the relationship between humidity and rotation speed of the fan.

FIG. 7 illustrates the relationship between humidity and rotation speed of the fan F.

Specifically, FIG. 7 illustrates the result of measuring the rotation speed of the fan F while the humidity is changed at a temperature of 20° C. and an atmospheric pressure of 1002 hPa. The relationship between humidity and rotation speed of the fan F is determined by linear approximation.

The fan F is in a brand-new condition in which image formation with the image forming apparatus 1 has not been performed yet.

As illustrated in FIG. 7, as the humidity increases, the rotation speed of the fan F driven at a predetermined voltage increases with a decrease of the rotational load. This is because the air density decreases with an increase of the ratio of water molecules in the air (decrease of the other components such as nitrogen molecules and oxygen molecules).

Next, the influence of atmospheric pressure on the rotation speed of the fan F will be described referring to FIG. 8.

Figure 8:
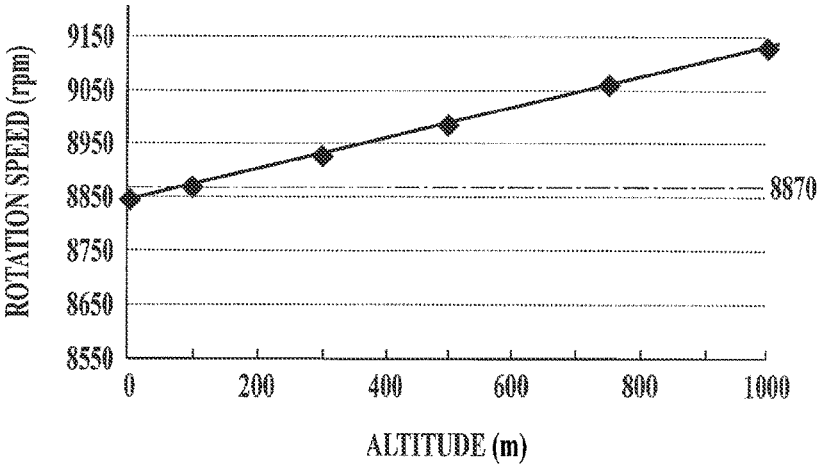
FIG. 8 illustrates the relationship between altitude and rotation speed of the fan.

Since atmospheric pressure is correlated with altitude, the relationship between altitude and rotation speed of the fan F is shown in FIG. 8.

Specifically, FIG. 8 illustrates the result of measuring the rotation speed of the fan F while the altitude of the installation location of the image forming apparatus 1 is changed at a temperature of 20° C. and a humidity of 50%. The relationship between altitude and rotation speed of the fan F is determined by linear approximation.

The fan F is in a brand-new condition in which image formation with the image forming apparatus 1 has not been performed yet.

As illustrated in FIG. 8, as the altitude increases (the atmospheric pressure decreases), the rotation speed of the fan F that is driven at a predetermined voltage increases with a decrease of the rotational load. This is because the air density decreases with an increase of the air volume.

As described above, since a change of the environmental conditions such as temperature, atmospheric pressure and humidity causes a change of the air density and thus affects the rotation speed of the fan F, it is necessary to take the environmental conditions in image formation with the image forming apparatus 1 into consideration in order to detect the bin 103 being full based on the change of rotation speed of the fan F.

To achieve this in the toner collection processing, the hardware processor 50 corrects the detected rotation speed of the fan F based on the change of the physical properties of the air that corresponds to a change of the environmental conditions in image formation. The hardware processor 50 then detects the bin 103 being full of toner based on the corrected rotation speed of the fan F. In the toner collection processing, the hardware processor 50 serves as a detector and a corrector.

That is, the hardware processor 50 detects the bin 103 being full of toner according to a detection control program.

Specifically, the hardware processor 50 calculates the rotation speed (number of rotations per unit time) of the fan F at predetermined time intervals based on pulse signals input from the fan F. The hardware processor 50 then detects the bin 103 being full based on the change of calculated rotation speed of the fan F.

For example, a reference rotation speed is defined as the rotation speed (8870 rpm) of the fan F at a temperature of 20° C., a humidity of 50% and an atmospheric pressure of 1002 hPa in a brand-new condition in which image formation with the image forming apparatus 1 has not been performed yet as illustrated in FIG. 4B, and it is determined that the bin 103 is full of toner when the rotation speed of the fan F increases by approximately 1.1% from the reference rotation speed (e.g. the rotation speed of the fan F changes from 8870 rpm to 8970 rpm).

Further, the hardware processor 50 corrects the rotation speed of the fan F according to the correction control program.

Specifically, the hardware processor 50 corrects the rotation speed of the fan F based on a change of air density that corresponds to at least one of the temperature, the atmospheric pressure and the humidity of the environmental conditions in image formation. For example, the hardware processor 50 calculates the corrected rotation speed co of the fan F from the temperature detection signal, the atmospheric pressure detection signal, the humidity detection signal and the like input from the measurement section 80 using the following Equation 1.

$$\omega = C \times (T + 273.15)^{1/3} \qquad \text{Equation 1}$$

In the equation, C is the correction factor, and T is the temperature.

Further, the hardware processor 50 adjusts the correction factor C for correcting the rotation speed of the fan F based on at least one of the atmospheric pressure and the humidity. Specifically, the hardware processor 50 calculates the correction factor C using the following Equation 2.

$$C = \left(\frac{W \cdot R}{k \cdot P}\left(1013 - \frac{11}{29}P_{W0}(T) \cdot RH\right)\right)^{\frac{1}{3}} \quad \text{Equation 2}$$

In the equation, W is the power consumption of the fan F, k is a constant according to the resistance of the fan F and the like, R is the gas constant, P is the atmospheric pressure, $P_{w0}(T)$ is the saturation water vapor pressure, and RH is the relative humidity.

In this way, the hardware processor 50 takes a change of a physical property (e.g. density) of the air, which corresponds to a change of the temperature, the atmospheric pressure and the humidity of the environmental conditions in image formation, into consideration when calculating the corrected rotation speed co of the fan F using the above-described Equation 1 and Equation 2.

The hardware processor 50 does not necessarily have to take all of temperature, atmospheric pressure and humidity of the environmental conditions in image formation into consideration but may use only one or more conditions that affect the change of air density to a comparatively large degree from among temperature, atmospheric pressure and humidity to correct the rotation speed of the fan F.

That is, the hardware processor 50 reads the relationship between rotation speed of the fan F and temperature (see FIG. 6), the relationship between rotation speed of the fan F and humidity (see FIG. 7) and the relationship between rotation speed of the fan F and altitude (atmospheric pressure) (see FIG. 8) and selects one condition (e.g. temperature) that has a comparatively steep approximation line as the one that affects the change of air density to a comparatively large degree. That is, humidity, atmospheric pressure and the like have a comparatively gradual approximation line compared to temperature and affect a change of air density to a comparatively small degree. In terms of simplifying the calculation to reduce the load, the necessity to take such environmental conditions into consideration is considered low.

In the following, a simplified method of correcting the rotation speed of the fan F based on a change of temperature as an environmental condition in image formation will be described.

The hardware processor 50 adjusts the reference rotation speed for calculating the corrected rotation speed co of the fan F based on the installation conditions of the image forming apparatus 1. For example, the hardware processor 50 sets the reference rotation speed at 20° C. to the rotation speed (8870 rpm) of the fan F in a brand-new condition at which the toner separation efficiency in the cyclone portion 102 reaches 98%. In this regard, the hardware processor 50 may take the altitude (atmospheric pressure) of the installation location of the image forming apparatus 1 into consideration. For example, the hardware processor 50 may adjust the reference rotation speed such that the value is higher as the altitude is higher (the atmospheric pressure is lower).

Further, the hardware processor 50 calculates the temperature correction factor $C_T$ based on the reference rotation speed at 20° C. and the relationship between rotation speed of the fan F and temperature (see FIG. 6). The hardware processor 50 then corrects the rotation speed of the fan F, which is calculated from the pulse signals input from the fan F, to a value at 20° C. using the following Equation 3.

$$\omega = C_T \times (20 - T) + e \quad \text{Equation 3}$$

In the equation, $C_T$ is the temperature correction factor, T is the temperature, e is the uncorrected rotation speed of the fan F.

With regard to the correction factor C that is calculated using Equation 2, the hardware processor 50 may similarly use only one condition (e.g. atmospheric pressure) that affects the change of air density to a comparatively large degree among from atmospheric pressure and humidity to calculate the correction factor C. For example, the hardware processor 50 calculates the correction factor C such that the value is lower as the altitude is higher.

As described above, in the image forming apparatus 1 according to the embodiment, the rotation speed of the fan F is detected and corrected based on a change of a physical property (e.g. density) of the air that corresponds to a change of environmental conditions (e.g. temperature, atmospheric pressure, humidity and the like) in image formation. Therefore, even when a change of the environmental conditions in image formation by the image forming apparatus 1 causes a change of a physical property of the air that affects the rotation speed of the fan F, the rotation speed of the fan F can be suitably corrected by taking the change of the physical property of the air into consideration. In particular, the rotation speed of the fan F can be more suitably corrected based on a change of a physical property of the air passing through the fan F.

Using the corrected rotation speed co of the fan F to detect the bin 103 being filled up with toner to the capacity enables detecting the bin 103 being full with high accuracy before the filter 105 is clogged. That is, instead of detecting the filter 105 being clogged by means of a sensor as in the prior art, the bin 103 being full is detected with high accuracy before the filter 105 is clogged. This can properly prevent the toner in the bin 103 from being blown up and dispersed in the image forming apparatus 1 after the bin 103 becomes full.

The corrected rotation speed co of the fan F can be accurately calculated, for example, by using the correction factor C for correcting the rotation speed of the fan F and the temperature T, in which the correction factor C can be properly adjusted based on the atmospheric pressure and the humidity. That is, a change of a physical property (e.g. density) of the air that corresponds to a change of all of the temperature, the atmospheric pressure and the humidity of the environmental conditions in image formation can be taken into consideration to correct the rotation speed of the fan F. This enables detection of the bin 103 being full with high accuracy before the filter 105 is clogged.

The corrected rotation speed ω of the fan F can be accurately calculated, for example, by using the temperature correction factor $C_T$ for correcting the rotation speed of the fan F, the temperature T and the uncorrected rotation speed e of the fan F. That is, from among the temperature, the atmospheric pressure and the humidity of the environmental conditions in image formation, a condition (e.g. temperature) that affects a change of the air density to a comparatively large degree can be used to correct the rotation speed of the fan F. This enables simple correction of the rotation speed of the fan F based on a condition that affects a change of the air density to a comparatively large degree. Furthermore, excluding conditions that affect a change of the air density to a comparatively small degree can simplify the calculation and reduces the load.

The rotation speed of the fan F in a brand-new condition in which image formation with the image forming apparatus 1 has not been performed yet, the installation condition of the image forming apparatus 1 such as the altitude at which the image forming apparatus 1 is installed, and the like can be taken into consideration to adjust the reference rotation speed that is used as a reference for calculating the corrected rotation speed ω of the fan F.

The cyclone portion 102, the bin 103 and the filter 105 are integrally formed and detachable from the apparatus main body 1A of the image forming apparatus 1. This enables integrally replacing the cyclone portion 102, the bin 103 and the filter 105 as one piece, for example, when the bin 103 becomes full. This can reduce the trouble and the cost of the replacement, and the toner stored in the bin 103 is suitably prevented from being dispersed in the image forming apparatus 1.

The present invention is not limited to the above-described embodiment, and a variety of improvements and design changes can be made without departing from the features of the present invention.

For example, in the embodiment, the total rotation time of the fan F, which is the sum of rotation times of the fan F, may be taken into consideration for correcting the rotation speed of the fan F. That is, since the rotational friction of the fan F gradually increases due to abrasion of the rotation shaft and the like, the hardware processor 50 may adjust the correction factor C or the temperature correction factor $C_T$ for correcting the rotation speed of the fan F based on the total rotation time of the fan F such that the value is higher as the total rotation time is longer.

In the embodiment, air density is used as a physical property of the air. However, this is merely an example, and the present invention is not limited thereto. For example, it may be suitably changed to air viscosity or the like.

Further, a change of a physical property of the air that is used to correct the rotation speed of the fan F is not necessarily a change of a physical property of the air passing through the fan F. For example, it may be a change of a physical property of the air near the fan F, a change of a physical property of the air flowing through the vacuum ducts 36 or the common duct 37, or a change of a physical property of the air inside or outside the image forming apparatus 1.

In the embodiment, the computing expressions are used to calculate the corrected rotation speed ω of the fan F. However, this is merely an example, and the present invention is not limited thereto. For example, a table (not shown) that corresponds corrected rotation speed ω of the fan F to a variety of environmental conditions such as temperature, atmospheric pressure and humidity may be used instead.

The configuration of the image forming apparatus 1 illustrated in the embodiment is merely an example, and the present invention is not limited thereto. For example, the image forming apparatus 1 does not necessarily have to include all of the four image forming units 30Y, 30M, 30C and 30K but only has to include at least any one of them. When only a part of the four image forming units 30Y, 30M, 30C and 30K is used for image formation, the vacuum ducts 36 for the unused image forming units may be sealed with a predetermined sealer (not shown). The cyclone portion 102, the bin 103 and the filter 105 of the toner collector 100 may be individually formed as separate members. In this configuration, the cyclone portion 102, the bin 103 and the filter 105 are individually replaceable.

In the embodiment, the functions as a detector and a corrector are achieved by the CPU of the hardware processor 50 executing a predetermined program and the like. However, these functions may be achieved by a predetermined logic circuit or the like instead.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent application No. 2016-240022, filed on Dec. 12, 2016, is incorporated herein by reference in its entirety.

What is claimed is:

1. An image forming apparatus, comprising:

a cyclone portion which separates toner from air containing dispersed toner by centrifugation;

a bin which stores the toner separated by the cyclone portion;

a filter which filters the air from which the toner has been separated by the cyclone portion;

a fan which generates an air flow for discharging the air which has passed through the filter;

a detector which detects the bin being full of the toner based on a change of a rotation speed of the fan; and a corrector which corrects the rotation speed of the fan based on a change of a physical property of the air which corresponds to a change of an environmental condition in image formation.

2. The image forming apparatus according to claim 1, wherein the physical property of the air comprises a density of the air.

3. The image forming apparatus according to claim 1, wherein the environmental condition comprises at least one of temperature, atmospheric pressure and humidity.

4. The image forming apparatus according to claim 1, wherein the corrector corrects the rotation speed of the fan by using one or more of temperature, atmospheric pressure and humidity that affect a change of a density of the air to a comparatively large degree.

5. The image forming apparatus according to claim 1, wherein the corrector adjusts a correction factor for correcting the rotation speed of the fan based on at least one of atmospheric pressure and humidity.

6. The image forming apparatus according to claim 1, wherein the corrector adjusts a correction factor for correcting the rotation speed of the fan based on a total rotation time which is a sum of rotation times of the fan.

7. The image forming apparatus according to claim 1, wherein the corrector calculates the corrected rotation speed of the fan using the following Equation, $$\omega = C_T \times (20 - T) + e$$

where ω is the corrected rotation speed of the fan, $C_T$ is a correction factor for temperature, T is temperature, and e is the uncorrected rotation speed of the fan.

8. The image forming apparatus according to claim 1, wherein the corrector adjusts a reference rotation speed for calculating the corrected rotation speed of the fan based on an installation condition of the image forming apparatus.

9. The image forming apparatus according to claim 8, wherein the corrector adjusts the reference rotation speed for calculating the corrected rotation speed of the fan based on the rotation speed of the fan in a condition in which image formation with the image forming apparatus has not been performed yet.

10. The image forming apparatus according to claim 8, wherein the corrector adjusts the reference rotation speed for calculating the corrected rotation speed of the fan based on an altitude of an installation location of the image forming apparatus.

11. The image forming apparatus according to claim 1, wherein the corrector corrects the rotation speed of the fan based on a change of a physical property of the air passing through the fan.

12. The image forming apparatus according to claim 1, wherein the cyclone portion, the bin and the filter are integrally formed and are configured to be detachable from a main body of the image forming apparatus.

* * * * *